US007396319B1

(12) United States Patent
Ellis

(10) Patent No.: US 7,396,319 B1
(45) Date of Patent: Jul. 8, 2008

(54) INNER AND OUTER THIGH EXERCISE MACHINE

(75) Inventor: Patrick D. Ellis, Milwaukee, WI (US)

(73) Assignee: Northland Industries, Inc., South Milwaukee, WI (US)

( * ) Notice: Subject to any disclaimer, the term of this patent is extended or adjusted under 35 U.S.C. 154(b) by 347 days.

(21) Appl. No.: 11/102,053

(22) Filed: Apr. 8, 2005

(51) Int. Cl.
*A63B 23/04* (2006.01)
*A63B 21/062* (2006.01)

(52) U.S. Cl. ..... 482/100; 482/136; 482/142; 482/907

(58) Field of Classification Search ..... 482/100, 482/133–138, 92–94, 97–103, 907; D21/673, D21/675, 676, 685, 686, 690; *A63B 21/062, A63B 23/04*
See application file for complete search history.

(56) References Cited

U.S. PATENT DOCUMENTS

| | | | | | |
|---|---|---|---|---|---|
| 4,185,818 | A | | 1/1980 | Brentham | |
| 4,240,627 | A | * | 12/1980 | Brentham | 482/112 |
| 4,478,411 | A | * | 10/1984 | Baldwin | 482/136 |
| 4,621,807 | A | | 11/1986 | Stramer | |
| 4,877,239 | A | | 10/1989 | Dela Rosa | |
| 5,102,121 | A | * | 4/1992 | Solow et al. | 482/94 |
| 5,277,681 | A | * | 1/1994 | Holt | 482/112 |
| 5,480,367 | A | | 1/1996 | Bergman | |
| 5,518,482 | A | | 5/1996 | Hsieh | |
| 5,562,578 | A | | 10/1996 | Guillemette | |
| 5,575,743 | A | * | 11/1996 | Jones et al. | 482/97 |
| 5,575,744 | A | | 11/1996 | Jones et al. | |
| 5,722,921 | A | * | 3/1998 | Simonson | 482/100 |
| 5,833,585 | A | * | 11/1998 | Jones et al. | 482/97 |
| 6,471,624 | B1 | * | 10/2002 | Voris | 482/142 |
| 7,029,427 | B2 | * | 4/2006 | Vuurmans et al. | 482/100 |
| 7,070,544 | B1 | * | 7/2006 | Rindfleisch | 482/97 |
| 7,128,695 | B2 | * | 10/2006 | Panatta | 482/100 |

FOREIGN PATENT DOCUMENTS

| | | | |
|---|---|---|---|
| DE | 20306997 U1 | * | 7/2003 |
| JP | 2006-122499 | * | 5/2006 |
| JP | 2006-239232 | * | 9/2006 |

* cited by examiner

*Primary Examiner*—Loan Thanh
*Assistant Examiner*—Oren I Ginsberg
(74) *Attorney, Agent, or Firm*—Andrus, Sceales, Starke & Sawall, LLP

(57) ABSTRACT

An inner and outer thigh exercise apparatus has a framework, and a seat and backrest mounted on the framework. Right and left leg supports are pivotally mounted on the framework about spaced apart pivot shafts relative to the seat and are interconnected with one another so as to pivot simultaneously in opposite angular directions between start and finish positions. A resistance arrangement is operatively connected to the leg supports for imposing a resistive force on the leg supports during pivoting movement thereof between start and finish positions. A motion transfer assembly is controllably mounted for selective rotation about a single pivot axis on one of the leg supports for enabling changing of the start positions of the leg supports, and allowing the imposition of resistive force on the leg supports during pivoting movement of the leg supports between start and finish positions.

7 Claims, 12 Drawing Sheets

INNER AND OUTER THIGH EXERCISE MACHINE

FIELD OF THE INVENTION

This invention relates generally to an apparatus with a resistance arrangement for exercising both the abductor and adductor muscles of the upper legs. More particularly, the invention pertains to a combination inner and outer thigh exercise machine which allows the changing of the start position of the leg receiving members of the machine while independently and separately providing for the imposition of resistive force as the leg receiving members are moved between start and finish positions.

BACKGROUND OF THE INVENTION

In exercising and conditioning the lower portion of the human body and, in particular, the legs, it is desirable to provide an exercising machine which will enable the abductor and adductor (inner and outer thigh) muscles to develop increased strength and flexibility. Such an exercise machine is a valuable adjunct to anterior and posterior leg exercise machines for performing leg extensions, leg curls and leg presses.

Although a variety of seated abductor and adductor devices of various configurations are known, there remains a need for an improved and more efficiently designed thigh exercise machine which provides adjustment in start positions of the leg receiving members along with selected imposition of resistive force thereon.

SUMMARY OF THE INVENTION

It is a general object of the present invention to provide an exercising machine for stimulating, developing, toning and firming the inner and outer muscles of the human thigh.

In one aspect of the invention, a thigh exercise apparatus has a framework, a seat mounted on the framework, right and left leg supports pivotally mounted on the framework about spaced apart pivot shafts relative to the seat and interconnected with one another so as to pivot simultaneously in opposite angular directions between start and finish positions. A resistance arrangement is operatively connected to the leg supports for imposing a resistive force on the leg supports during pivoting movement thereof between the start and finish positions. The invention is improved by a motion transfer assembly controllably mounted about a single pivot axis on one of the leg supports for enabling changing of the start positions of the leg supports, and allowing the imposition of resistive force on the leg supports during pivoting movement of the leg supports between start and finish positions.

In another aspect of the invention, a machine is provided for exercising abductor and adductor muscles of the leg and includes a framework, and a seat mounted on the framework. Right and left leg supports are pivotably mounted on the framework on spaced apart pivot shafts relative to the seat and are interconnected so as to pivot one with the other in opposite angular directions between start positions and finish positions. A resistance arrangement is operatively connected to the leg supports for imposing a resistive force on the leg supports during pivoting movement thereof between the start and finish positions. A motion transfer assembly is controllably mounted for selective rotation on one of the pivot shafts for enabling changing the start positions of the leg supports relative to one another while separately and independently allowing the imposition of resistive force on the leg supports as the leg supports are pivoted between the start and finish positions. The machine includes thigh engaging structure freely rotatably secured on the leg supports for selectively engaging inner and outer portions of an exerciser's thighs. One of the pivot shafts has a vertical axis that passes through the seat. The motion transfer assembly includes a first plate, a second plate and a third plate, all coaxially mounted on the one of the pivot shafts, the first plate being rotatable with one of the second and third plates.

In yet another aspect of the invention, a combination inner and outer thigh exercise machine includes a framework and a seat with a backrest joined to the framework. Right and left leg supports are pivotally mounted on the framework on spaced apart pivot shafts relative to the seat and the backrest, and are interconnected so as to pivot one with the other in opposite angular directions between start and finish positions. Thigh engaging structure is freely rotatably secured on the leg supports for selectively engaging inner and outer portions of an exerciser's thighs. A resistance arrangement is operatively connected to the leg supports for imposing a resistance force on the leg supports during pivoting movement thereof between the start and finish positions. An adjustment assembly is associated with one of the leg supports for selectively enabling changing the starting positions of the leg supports without imposing the resistive force of the resistance arrangement thereon. The adjustment assembly has a portion mounted for selective rotation on the pivot shaft associated with the one leg support. A resistive force imposing assembly has a portion mounted for selective rotation on the pivot shaft associated with the one leg support and is directly engaged with the portion of the adjustment assembly to impose a resistive force on the leg supports as the leg supports are pivoted between the start and finish positions. The resistance arrangement includes a weight stack having a cable operably connected to the resistive force imposing assembly. The leg supports include right and left foot supports on forward ends thereof. The leg supports include a pair of bearing tubes between the foot supports and the pivot shafts for receiving the thigh engaging structure. The portion of the resistive force imposing assembly includes an upper and lower cam arrangement variously engageable with the portion of the adjustment assembly. The force imposing assembly also includes a swing arm assembly connected on the framework between the resistance arrangement and the cam arrangement.

In still a further aspect of the invention, an adductor and abductor exercise apparatus includes a framework and a seat with a backrest joined to the framework. Right and left leg supports are pivotably mounted on the framework on spaced apart pivot shafts relative to the seat and the backrest and are interconnected so as to pivot one with the other in opposite angular directions between start and finish positions. Thigh engaging structure is freely rotatably secured on the supports for selectively engaging inner and outer portions of an exerciser's thighs. A resistance arrangement is operatively connected to the leg supports for imposing a resistive force on the leg supports during pivoting movement thereof between the start and finish positions. An actuating lever is connected to one of the leg supports for selectively pivoting a pin between a non-engagement position and an engagement position to establish selected start positions for the leg supports without imposing the resistive force thereon. A range limiter plate is engageable and disengageable with the pin of the actuating lever, and is mounted for selective rotation on the pivot shaft associated with the one leg support, the range limiter plate being provided with an engagement member. An upper cam plate is mounted for selective rotation on the pivot shaft associated with the one leg support and is formed with a slot for receiving an engagement member on the range limiter plate. A lower cam plate is mounted for selective rotation on the pivot shaft associated with the one leg support, and is formed with a slot for receiving the engagement member of the range limiter plate. A swing arm has one end pivotally attached to the framework and an opposite end operatively connected to the resistance arrangement. A pulley is rotatably mounted on the swing arm, and a cable is engaged with the upper cam plate, the pulley and the lower cam plate.

Disengagement of the pin from the range limiter plate allows movement of the leg supports to various start positions without rotation of the range limiter plate. Pivoting of the leg supports between start and finish positions with the pin engaged in the range limiter plate causes rotation of the range limiter plate and one of the upper and lower cam plates along with the corresponding movement of the cable, pulley and swing arm to impose a resistive force on the leg supports during movement between the start and finish positions. The pin is normally spring biased and the upper and lower cam plates have cable retaining and guiding structure provided thereon. The exercise apparatus includes a pair of sheaves rotatably mounted on the pivot shafts and interconnected by a cable for enabling pivoting of the leg supports in opposite angular directions.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
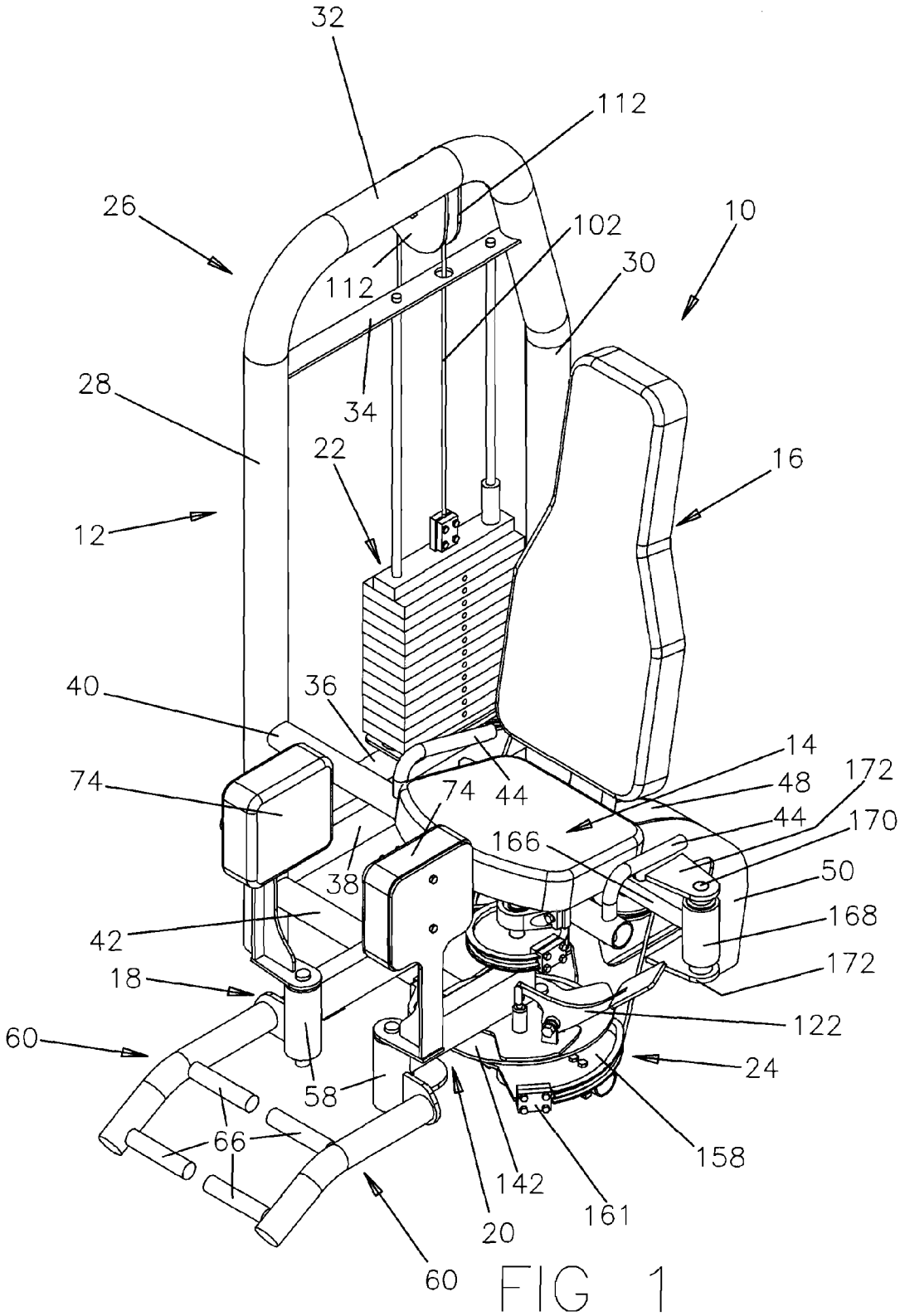
FIG. 1 is a perspective view of an inner and outer thigh exercise machine embodying the present invention and showing a start position for exercising one's outer thighs.
Figure 1A:
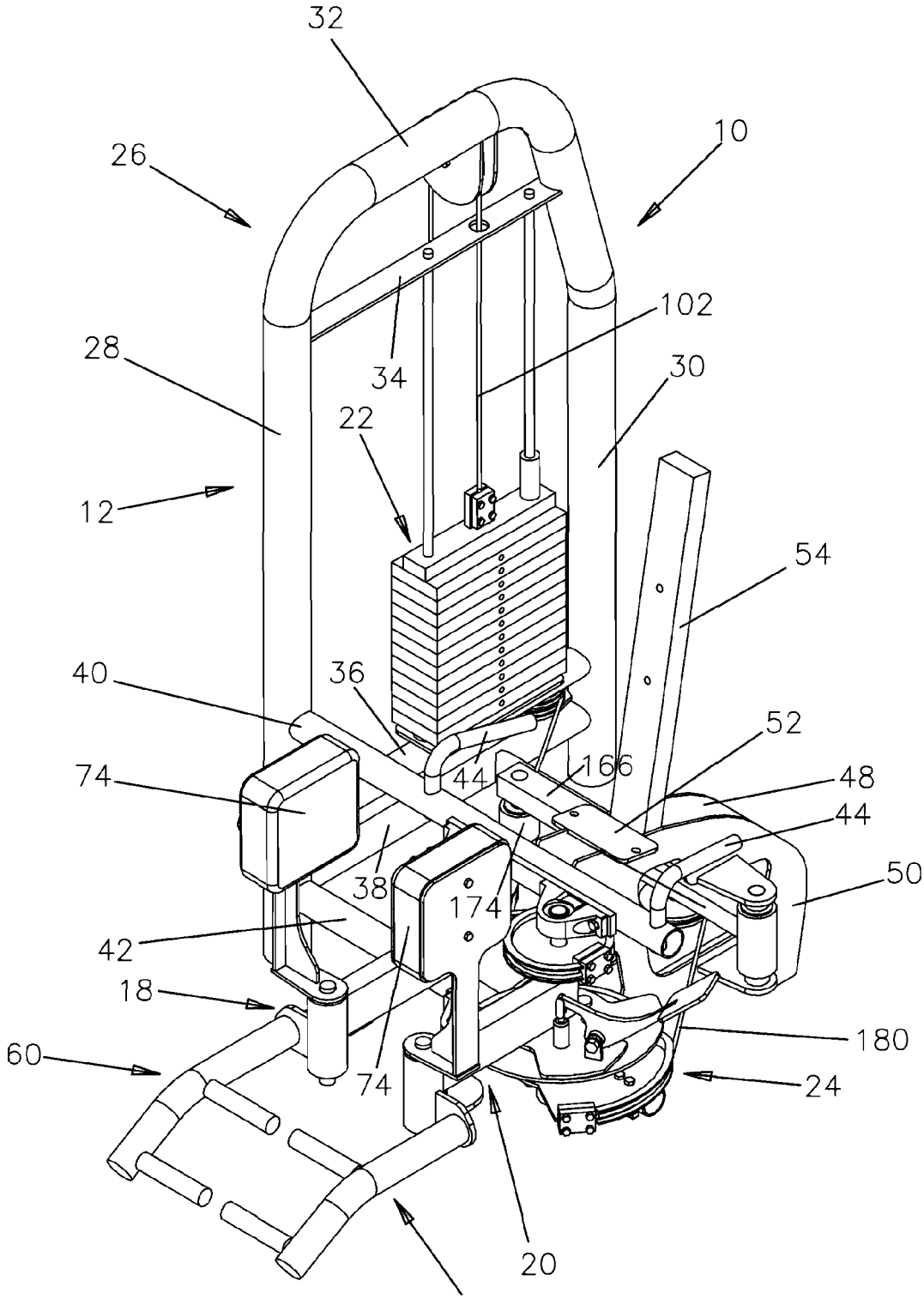
FIG. 1A is a view like FIG. 1 showing the seat and the backrest removed.

Referring now the drawings, FIGS. 1 and 1A illustrate an exercise machine 10 capable of exercising one's inner thighs in one setting, and exercising one's outer thighs in another setting in accordance with the present invention.

The machine 10 is generally comprised of a floor-engaging framework 12, a seat 14 and a backrest 16 mounted on the framework 12, right and left leg supports 18, 20 pivotably mounted on the framework 12, a resistance arrangement 22 operatively connected to the leg supports 18, 20 and a motion transfer assembly 24 mounted for selective rotation on one of the leg supports 18, 20.

In the descriptions to follow, references to the terms "front", "forward", "back", "rear", "left", "right", "upper", "lower", "top", and "bottom" are to be taken from the perspective of an exerciser seated with his/her back against the rest 16.

Figure 2:
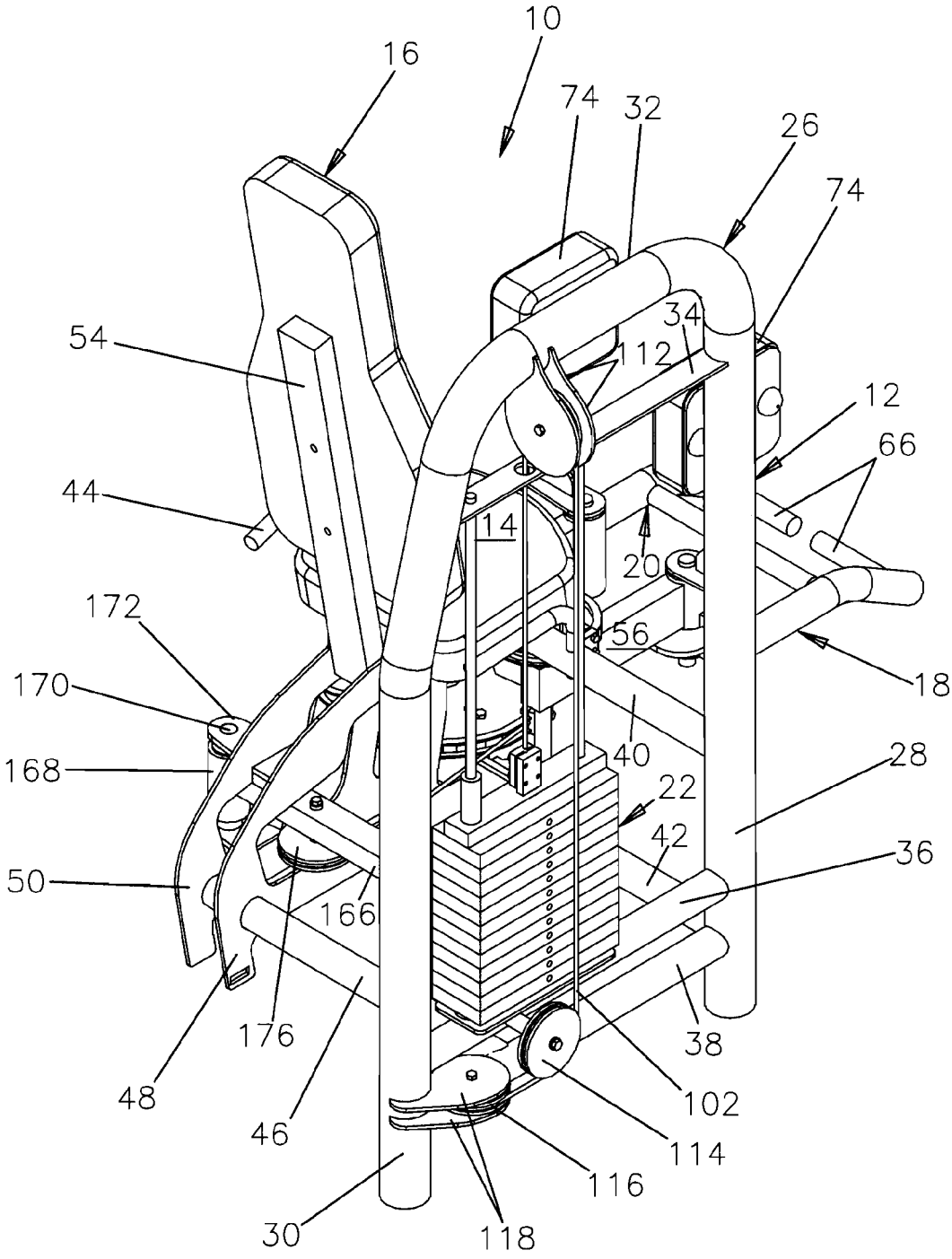
FIG. 2 is a right rear perspective view of the machine of FIG. 1.
Figure 2A:
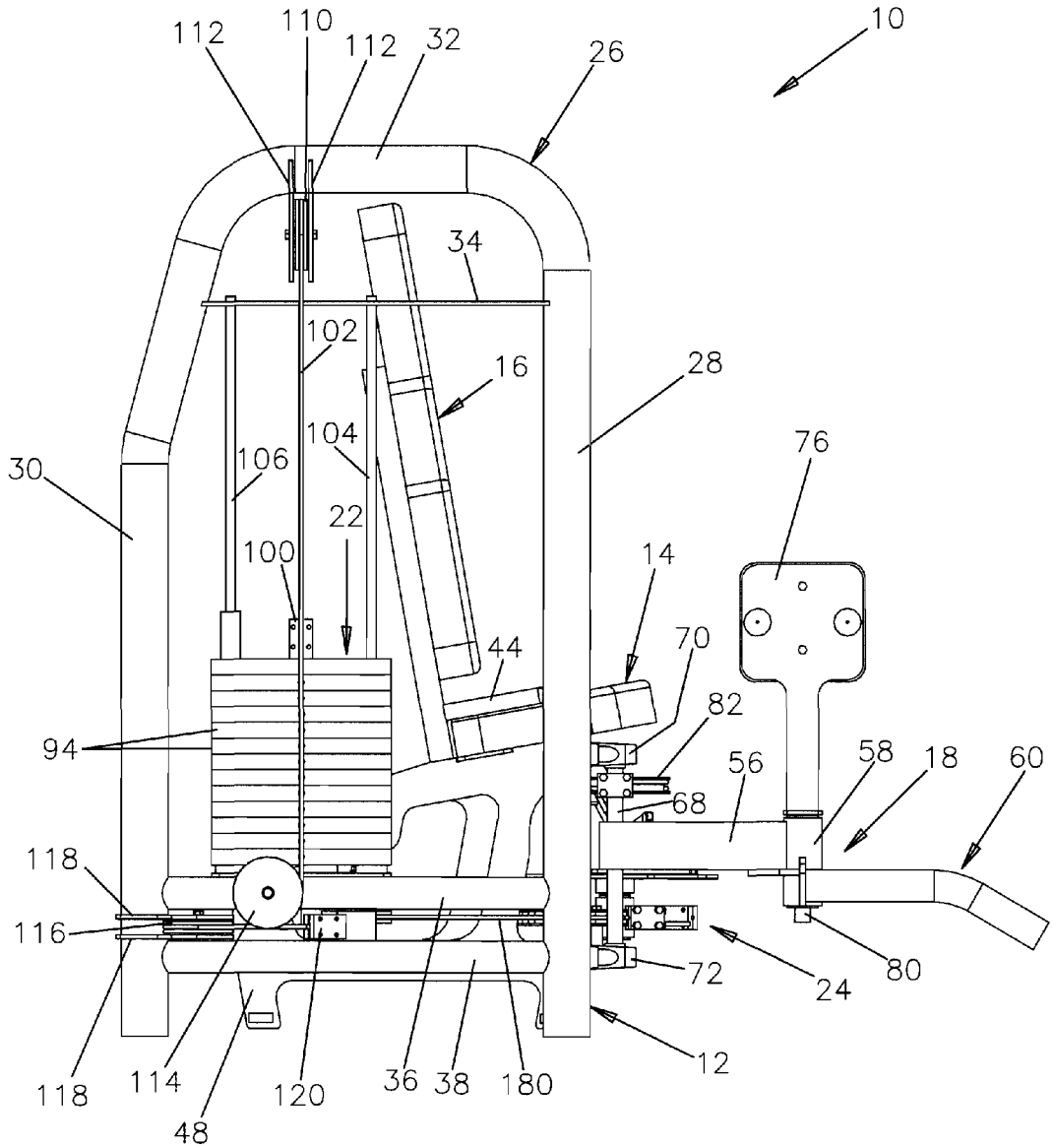
FIG. 2A is a side elevational view of FIG. 2.

Referring also to FIGS. 2 and 2A, the framework 12 includes an inverted, generally U-shaped weight stack rack 26 having an upright 28 and a forwardly angling, rear upright 30 connected by a bridge portion 32 at its upper end. The upper portion of rack 26 is designed with a cross plate 34, and the lower portion of racks 26 is provided with first and second cross members 36, 38 extending between the front and rear uprights 28, 30. An upper front transverse member 40 and a lower front transverse member 42 extend laterally and perpendicularly from the front upright 28. The upper front transverse member 40 is equipped with a pair of spaced apart rearwardly extending handles 44 to be grasped by the exerciser while seated during exercise. A rear transverse member 46 projects laterally and perpendicularly from the second cross member 38. A pair of spaced apart, vertical support plates 48, 50 have back ends joined to the rear transverse member 46, and front ends engaged with the front transverse members 40, 42. Bottom ends of the front and rear uprights 28, 30 and the vertical support plates 48, 50 provide contact points for supporting the machine 10 on a flat supporting surface, such as a floor. As seen in FIG. 1A, a mounting plate 52 is fixed across the top of the vertical support plates 48, 50 for holding seat 14, and a support arm 54 is joined between the vertical support plates 48, 50 for mounting backrest 16. The seat 14 and backrest 16 are oriented so that the exerciser's upper legs are raised slightly upwardly from the horizontal plane of the floor.

Figure 3:
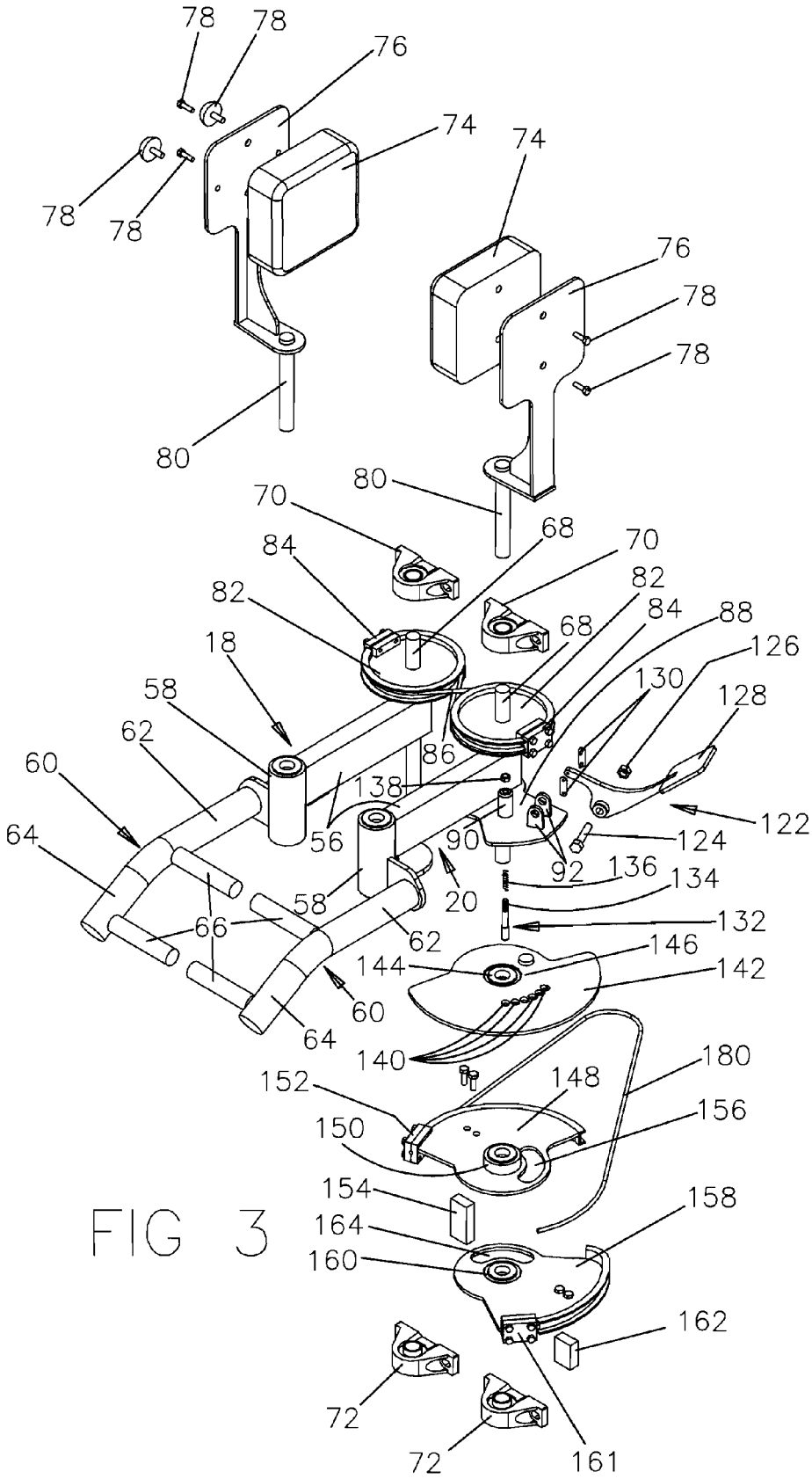
FIG. 3 is an exploded, perspective view of key components used on the front of the machine shown in FIG. 1.

With further reference to FIG. 3, right and left leg supports 18, 20 are similar in construction and each includes a linear lever arm 56, a vertically disposed bearing tube 58 and a foot rest assembly 60 offset outwardly relative to the lever arm 56. Each foot rest assembly 60 has a linear rear portion 62 and a downwardly extending front portion 64 provided with inwardly extending foot pegs 66 for supporting the foot of an exerciser. The rearward end of each leg support 18, 20 is welded to a vertical pivot shaft 68 which is swingably attached to the framework 12 by upper and lower pillow block bearings 70, 72 fixed to the upper and lower front transverse members 40, 42, respectively. Each of the pivot shafts 68 has a pivot axis which passes through the seat 14. Each leg support 18, 20 carries a rotatable thigh engaging structure including a thigh engaging, upholstered pad 74 joined to a rigid support plate 76 by fasteners 78. The lower end of each support plate 76 has a shaft 80 which is mounted for rotation inside bearing tube 58. A round sheave 82 with a cable retainer 84 is rotatably mounted on each pivot shaft 68 between the upper pillow block bearing 70 and the linear lever arm 56. A cable 86 is wrapped around both sheaves 82 in a FIG. 8 configuration with cable ends held by the retainers 84 so that when one leg support 18 or 20 is pivoted in one direction, the other leg support 20 or 18 is pivoted in the opposite direction in a balanced manner.

In the preferred embodiment, the lever arm 56 on the left leg support 20 includes a flat mounting plate 88 extending outwardly therefrom. The mounting plate 88 is provided with a vertical tube 90 and a pair of mounting ears 92 upstanding therefrom for a purpose to be detailed below.

Figure 6:
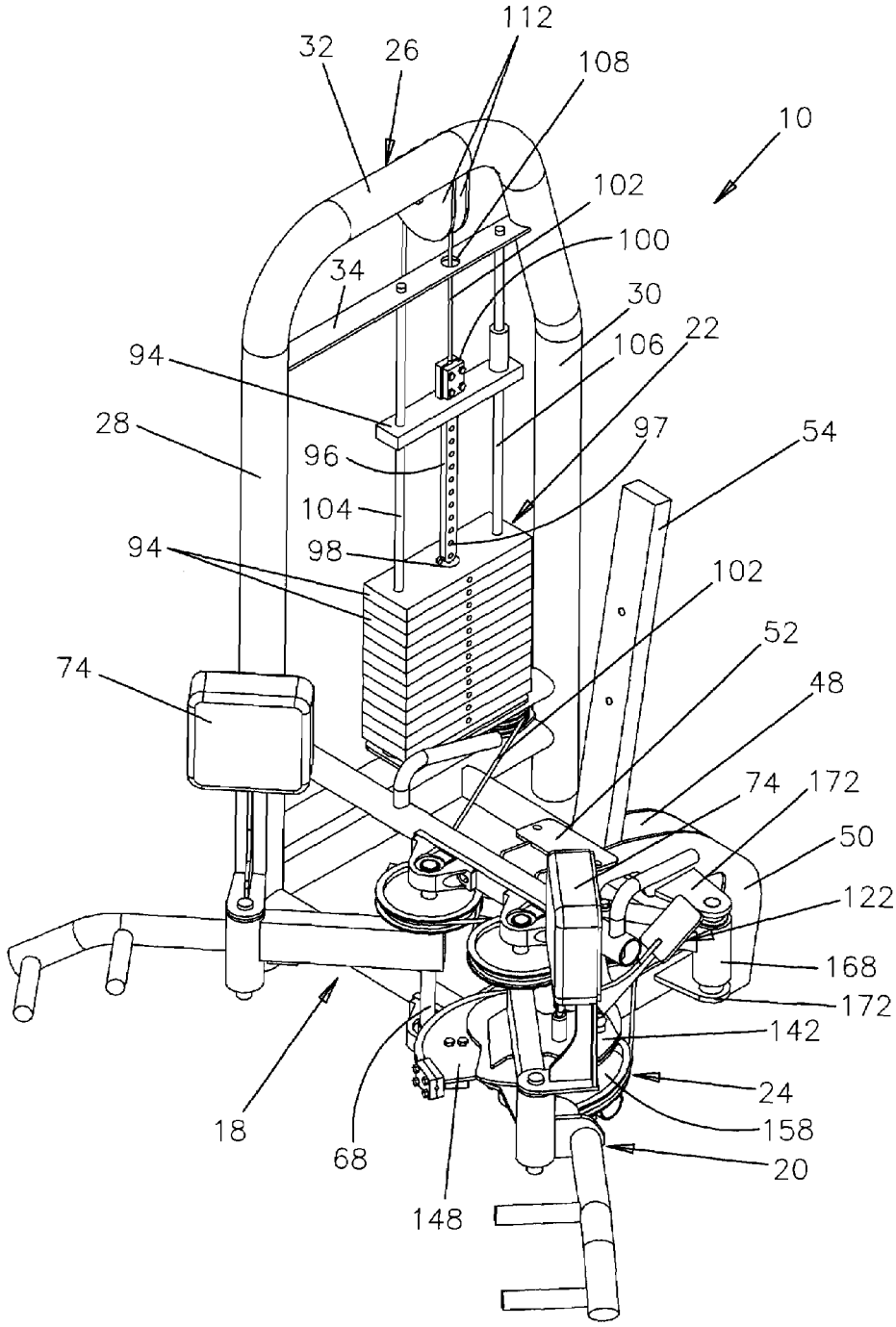
FIG. 6 is a perspective view of the machine of FIG. 1 in a finished position.

The resistance arrangement 22 depicted in FIGS. 1, 1A, 2, and 2A, includes a set of generally rectangular weight plates 94 arranged in a vertical stack and supported on first cross member 36. As best seen in FIG. 6, a main selector bar 96 has a series of spaced apart apertures 97 formed therein and passes through aligned central openings 98 in the weight plates 94. The main selector bar 96 is operably connected by a cable clamp 100 at its upper end to a cable 102. The cable 102 lifts the bar 96 and any weight plates 94 attached thereto along a pair of first and second guide rods 104, 106, respectively, which extend between the cross member 36 and the cross plate 34. The cable 102 extends through an opening 108 in the cross plate 34 and passes around a pulley 110 rotatably mounted between spaced apart plates 112 fixed to the bight portion 72 of the rack 26. As shown most clearly in FIGS. 2 and 2A, the cable 102 travels downwardly around a first lower pulley 114 rotatably secured about a horizontal axis to first cross member 36. The cable 102 continues around a second lower pulley 116 mounted for rotation about a vertical axis between another pair of spaced plates 118 joined to the rear upright 30 between the cross members 36, 38. The cable 102 is then connected by a cable clamp 120 to the motion transfer assembly 24 and leg supports 18, 20 as generally represented in FIG. 6. The amount of weight in the stack lifted by the exerciser depends upon the number of weight plates 94 connected to the selector bar 96. A removable pin (not shown) is normally provided which must be manually repositioned in a desired selector bar aperture 97 by the exerciser to pin one or more of the plates 94 to the selector bar 96 for movement therewith.

In accordance with the invention, the motion transfer assembly 24 is controllably mounted about a single pivot axis on one of the leg supports 18, 20 for enabling changing of the start positions of the leg supports 18, 20, and allowing imposition of resistive force on the leg supports 18, 20 during pivoting movement of the leg supports 18, 20 between start and finish positions.

More particularly, the motion transfer assembly 24 has an adjustment assembly associated with one of the leg supports for selectively enabling changing the start positions of the leg supports 18, 20 without imposing the resistive force of the resistance arrangement 22 thereon. The adjustment assembly has a portion mounted for selective rotation on the pivot shaft 68 associated with the left leg support 20. The motion transfer assembly 24 further has a resistive force imposing assembly having a portion mounted for selective rotation on the pivot shaft 68 associated with the left leg support 20 and directly engaged with the portion of the adjustment assembly to impose the resistive force on the leg supports 18, 20 as they are pivoted between start and finish positions.

Referring to FIG. 3, the adjustment assembly includes an actuating lever 122 which is pivotally joined between the mounting ears 92 by a bolt 124 and nut 126. The actuating lever 122 has one end provided with a generally rectangular hand-engaging portion 128, and an opposite end coupled with a pair of links 130. The links 130 are engageable with an upper end of a spring pin 132 mounted for up and down movement in tube 90. The spring pin 132 consists of an elongated pin 134 surrounded by a coil spring 136 which is held therein by fastening a nut 138 on a threaded end of the pin 134. The spring pin 132 is designed so that the spring 136 will normally bias the pin 134 downwardly out of tube 90 and into one of a series of holes 140 formed in a range limiter plate 142 located beneath the mounting plate 88. The range limiter plate 142 has a bearing 144 which receives the pivot shaft 68 on the left leg support 20 so that the range limiter plate 142 is selectively rotatable about the pivot shaft 68. The range limiter plate 142 also features a downwardly depending engagement pin 146 fixed thereto and positioned between the bearing 144 and the series of holes 140.

The resistive force imposing assembly includes an upper and lower cam arrangement variously engageable with the engagement pin 146 on the range limiter plate 142. More specifically, as seen in FIG. 3, an upper cam plate 148 has a bearing 150 for accommodating pivot shaft 68 on left leg support 20 so as to permit selective rotation of the upper cam plate 148 below the range limiter plate 142. The upper cam plate 148 carries a cable clamp 152 on a portion of its periphery, and has a stop block 154 extending from the bottom surface. The upper cam plate 148 is formed with a curved slot 156 for receiving the engagement pin 146. A lower cam plate 158 has a bearing 160 for receiving pivot shaft 68 on left leg support 20 so as to permit selective rotation of the lower cam plate 158 below the upper cam plate 148. The lower cam plate 158 has a cable clamp 161 on a portion of its periphery, and a depending stop block 162 on its underside. The lower cam plate 158 is constructed with a curved slot 164 which also receives the engagement pin 146. The upper and lower cam plates 148, 158 and the range limiter plate 142 are all coaxially mounted for selective rotation on the pivot shaft 68 of the left leg support 20.

Figure 4:
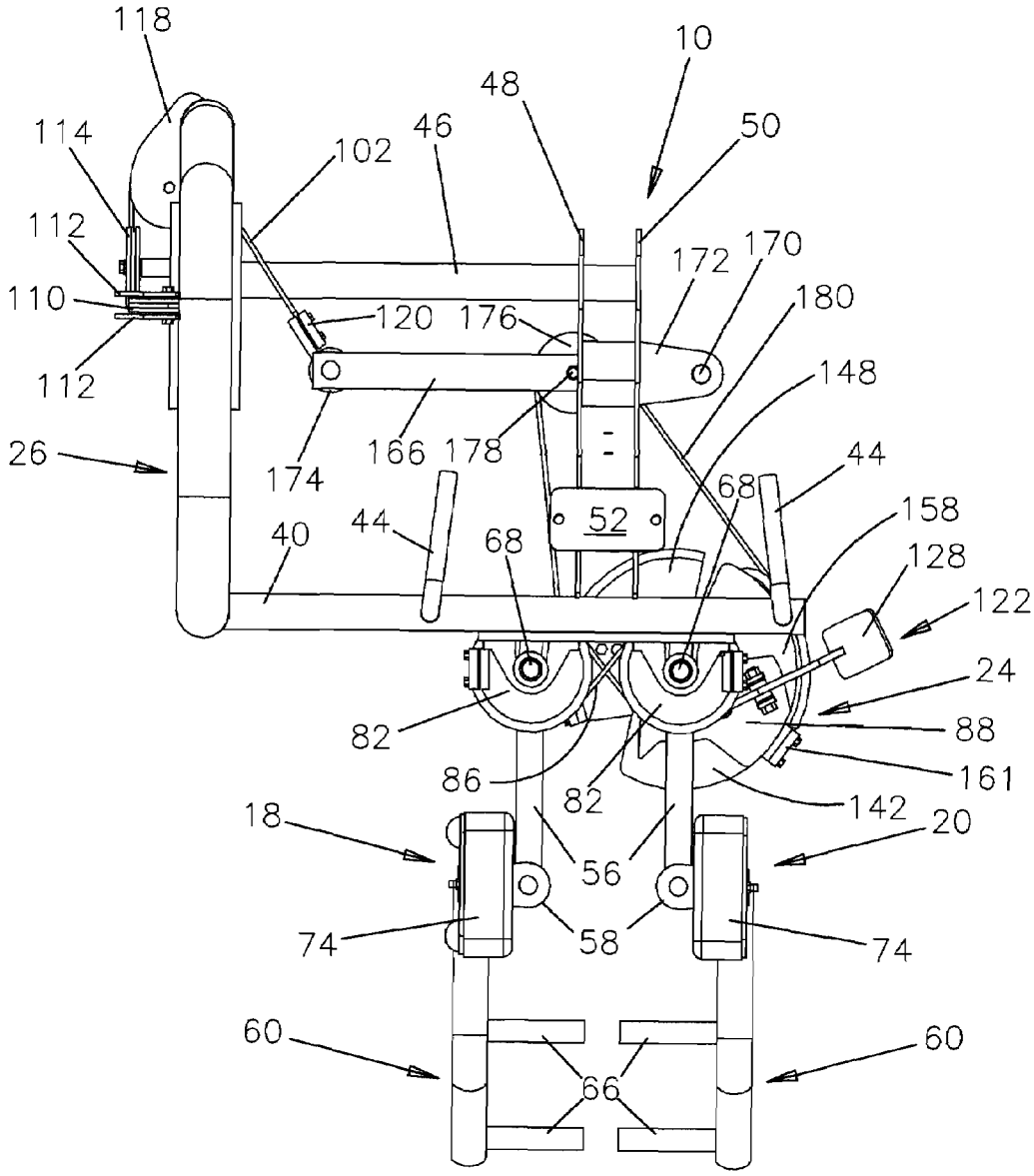
FIG. 4 is a top view of the machine of FIG. 1.

The resistive force imposing assembly further includes a swing arm assembly pivotally connected on the framework 12 between the resistance arrangement 22 and the upper and lower cam plates 148, 158. As best seen in FIG. 1, swing arm assembly includes an elongated swing arm 166 having a first end fixed to a bearing tube 168 which is swingably mounted on a pin 170 extending between a pair of spaced apart plates 172 projecting from vertical support plate 50. A second end of the swing arm 166 carries a rotatable bearing tube 174 which is connected by the cable clamp 120 to the weight plates 94 of the resistance arrangement 22. As seen in FIGS. 2 and 4, a pulley 176 is mounted for rotation about a pin 178 passing through the swing arm 166 adjacent its first end. The pulley 176 thus rotates on and moves with the swing arm 166. A force transferring cable 180 has one end attached to the cable clamp 152 on the upper cam plate 148, and has an opposite end fixed to the cable clamp 160 on the lower cam plate 158. The cable 180 wraps around a peripheral groove on the upper cam plate 148, extends rearwardly and wraps around pulley 176 and then returns forwardly to wrap around a peripheral groove on the lower cam plate 158.

Figure 5:
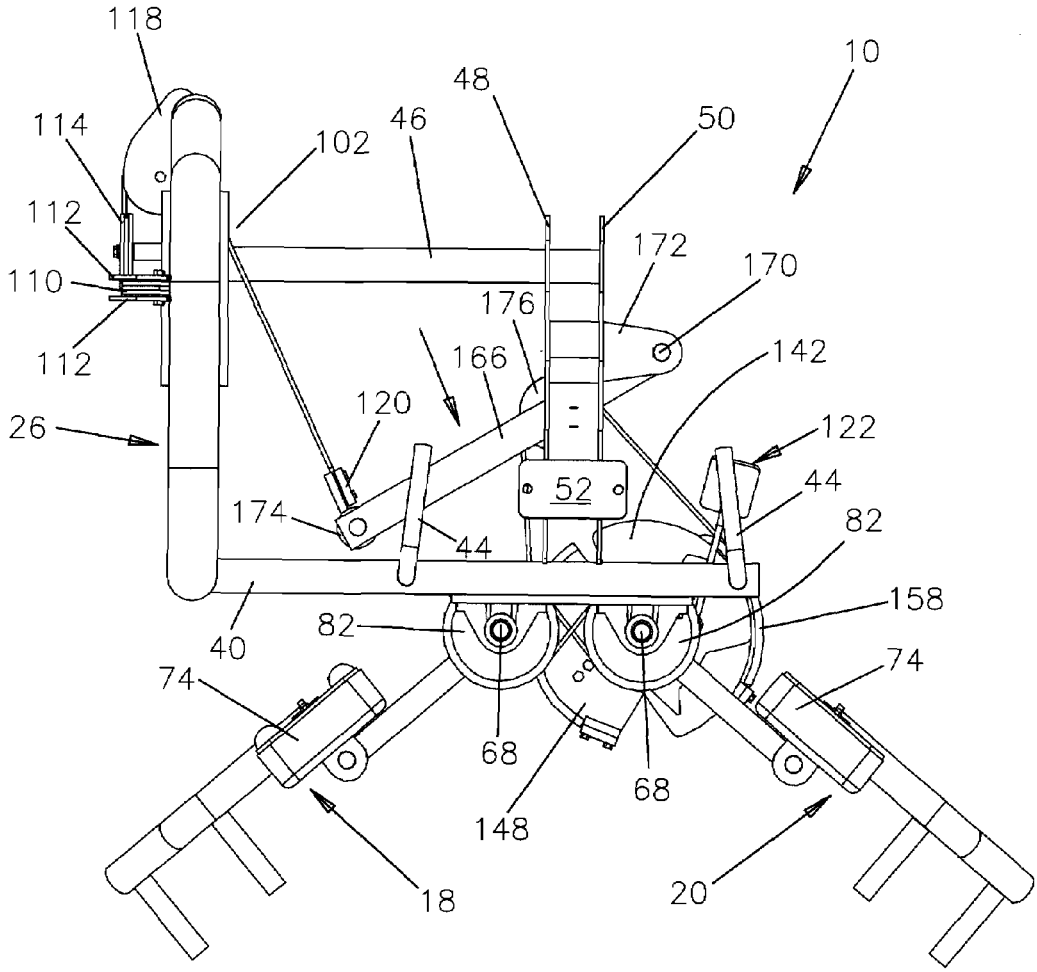
FIG. 5 is a top view of the machine of FIG. 1 in a finished position for exercising one's outer thighs.

FIGS. 1, 1A, 2 and 4, show the machine 10 in a start position for outer thigh exercise. In FIGS. 1A and 4, the seat 14 and backrest 16 are removed so that the mechanical operating components can be best illustrated. The exerciser will be positioned on the seat 14 with his/her back against the rest 16. The exerciser's legs are placed between the thigh pads 74 with the padded portion facing inward. The exerciser's feet rest appropriately on the foot pegs 66 on the forward end of the leg supports 18, 20. The leg supports 18, 20 are rotated to a selected adjustable start position which will accommodate the exerciser's leg size by pressing the actuating lever 122 downwardly. This motion disengages the spring pin 132 from the range limiter plate 142 allowing the leg supports 18, 20 to swing without moving any of the weight plates 94. When the desired position is reached, the exerciser releases the actuating lever 122 which allows the spring pin 132 to engage the walls of a selected hole 140 in the range limiter plate 142 to lock the leg supports 18, 20 thereto. During this initial leg support movement while the spring pin 132 moves between non-engagement and engagement positions to establish a desired start position, there is no rotational movement of the range limiter plate 142 or the upper and lower cam plates 148, 158. The exerciser can now exert pressure on the thigh pads 74 with the outer portion of the thighs causing the leg supports 18, 20 to rotate on their respective pivot shafts 68 so that the leg supports move away from each other in opposite directions. As the left leg support 20 is rotated counterclockwise, the engagement pin 146 presses against the left end of the slot 156 in the upper cam plate 148 and causes it to rotate counterclockwise. The engagement pin 146 rides free in the slot 164 of the lower cam plate 158 and does not cause it to rotate. Stop block 162 on the lower cam plate 158 is positioned against the lower front transverse member 42 of the framework 12 to further prevent the lower cam plate 158 from rotating counterclockwise. Driving the upper cam plate 148 counterclockwise pulls the cam connecting cable 180 and forces the swing arm 166 counterclockwise. This pulls the weight stack cable 102 lifting the weight plate 94 and causing resistance to the movement of the leg supports 18, 20 as they move towards the finished positions shown in FIGS. 5 and 6 where again, the seat 14 and the backrest 16 are removed for better understanding of the machine movement.

Figure 7:
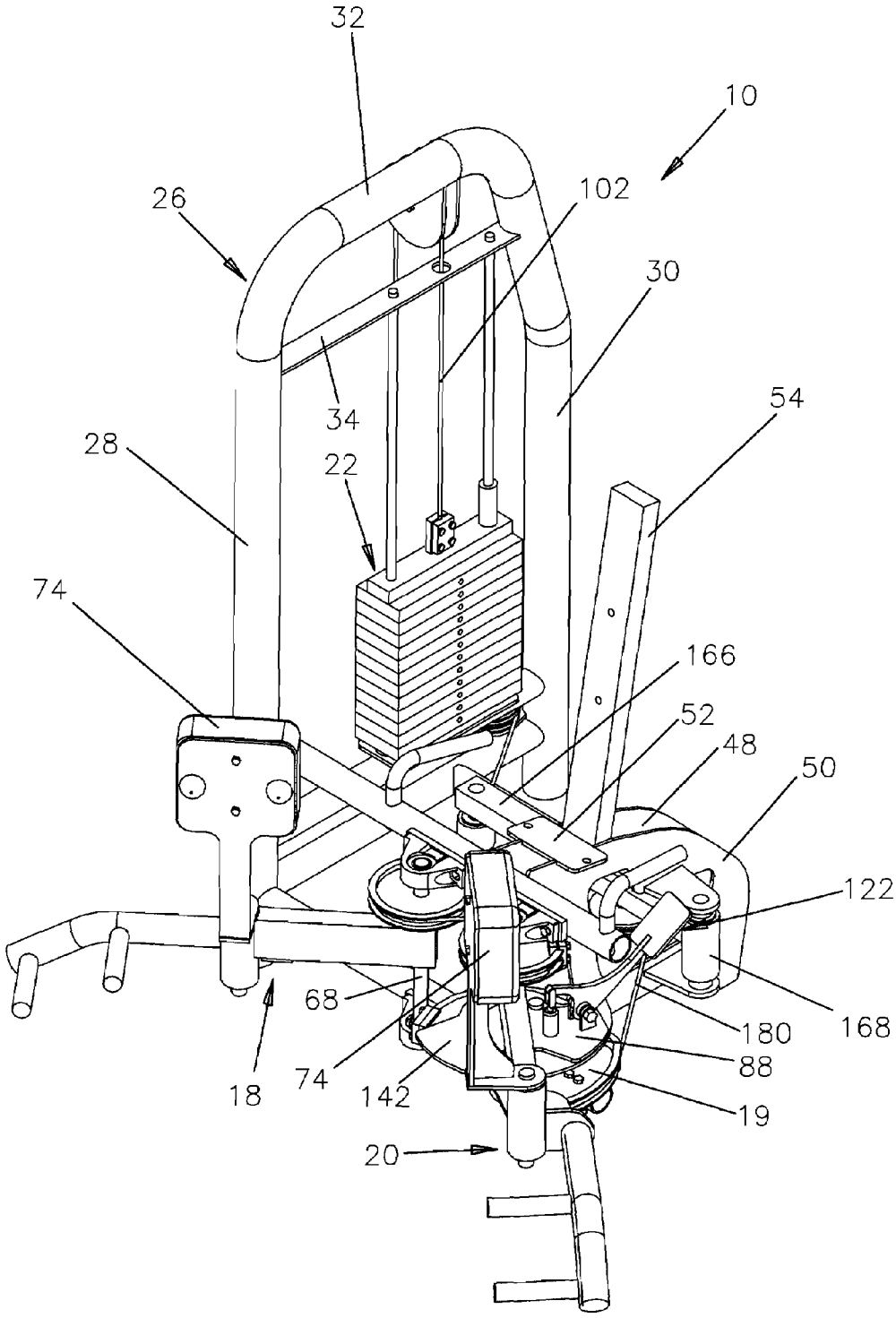
FIG. 7 is a perspective view of the machine of FIG. 1A showing a start position for exercising one's inner thighs.
Figure 8:
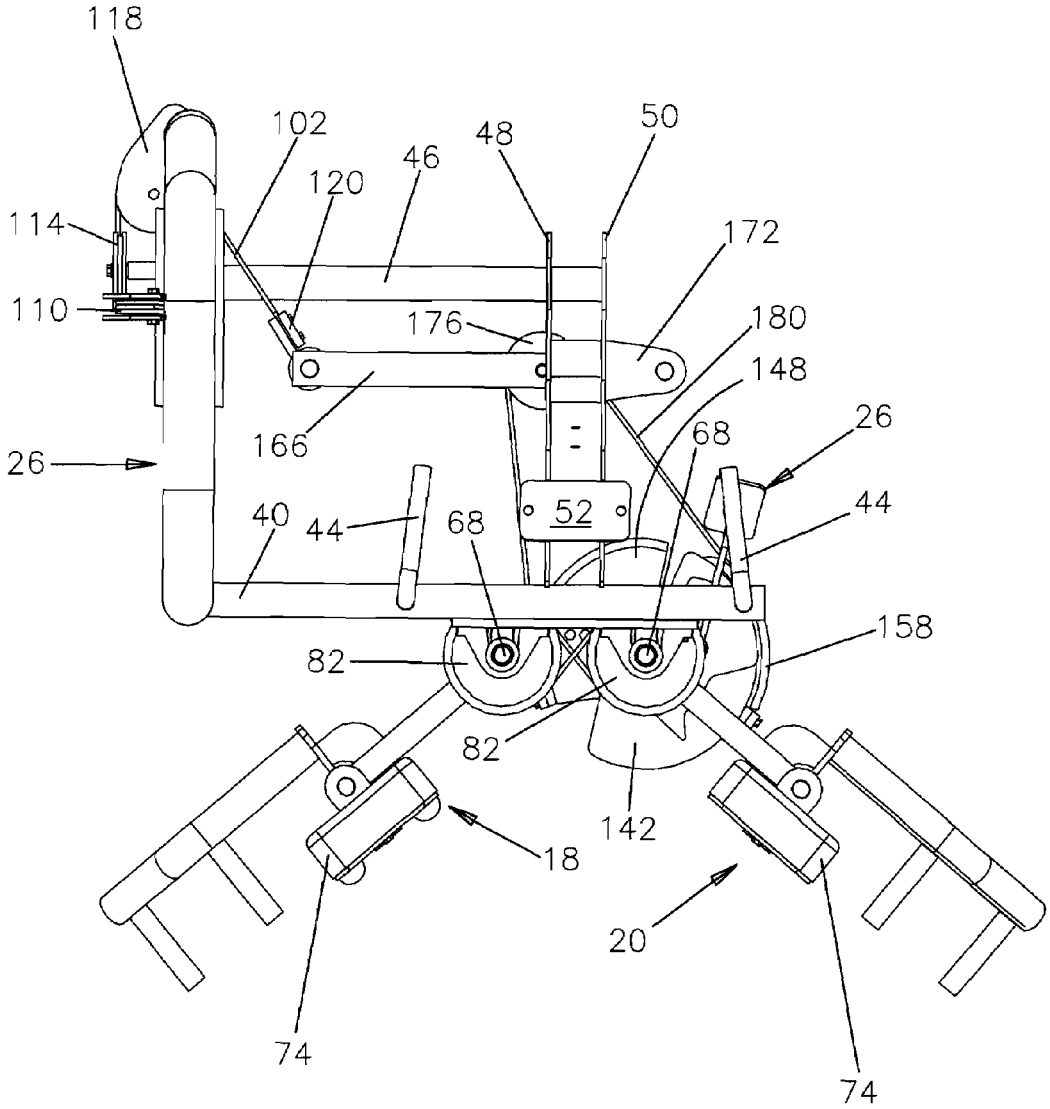
FIG. 8 is a top view of the machine of FIG. 7.

FIGS. 7 and 8 illustrate a start position for inner thigh exercise with the seat 14 and the backrest 16 removed for clarity in the drawings. With the exerciser in the seated position as before described, the exerciser's legs are placed outside of the thigh pads 74 with the padded portions rotated outwardly. The leg supports 18, 20 are rotated outwardly to a selected start position which will accommodate the exerciser's flexibility by using the actuating lever 122 to engage the range limiter plate 142 as described above.

Figure 9:
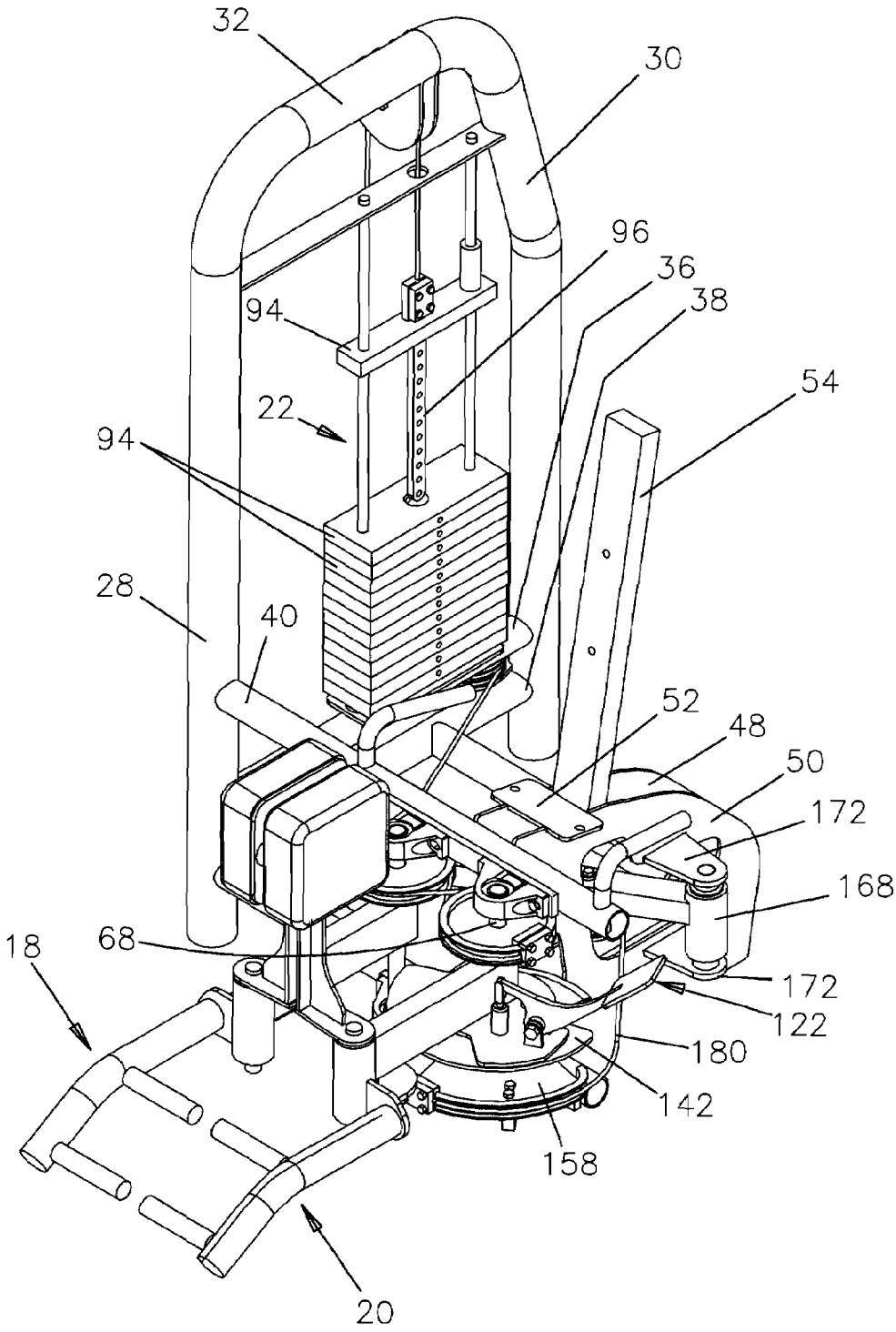
FIG. 9 is a perspective view of the machine of FIG. 1A showing a finished position for exercising one's inner thighs.
Figure 10:
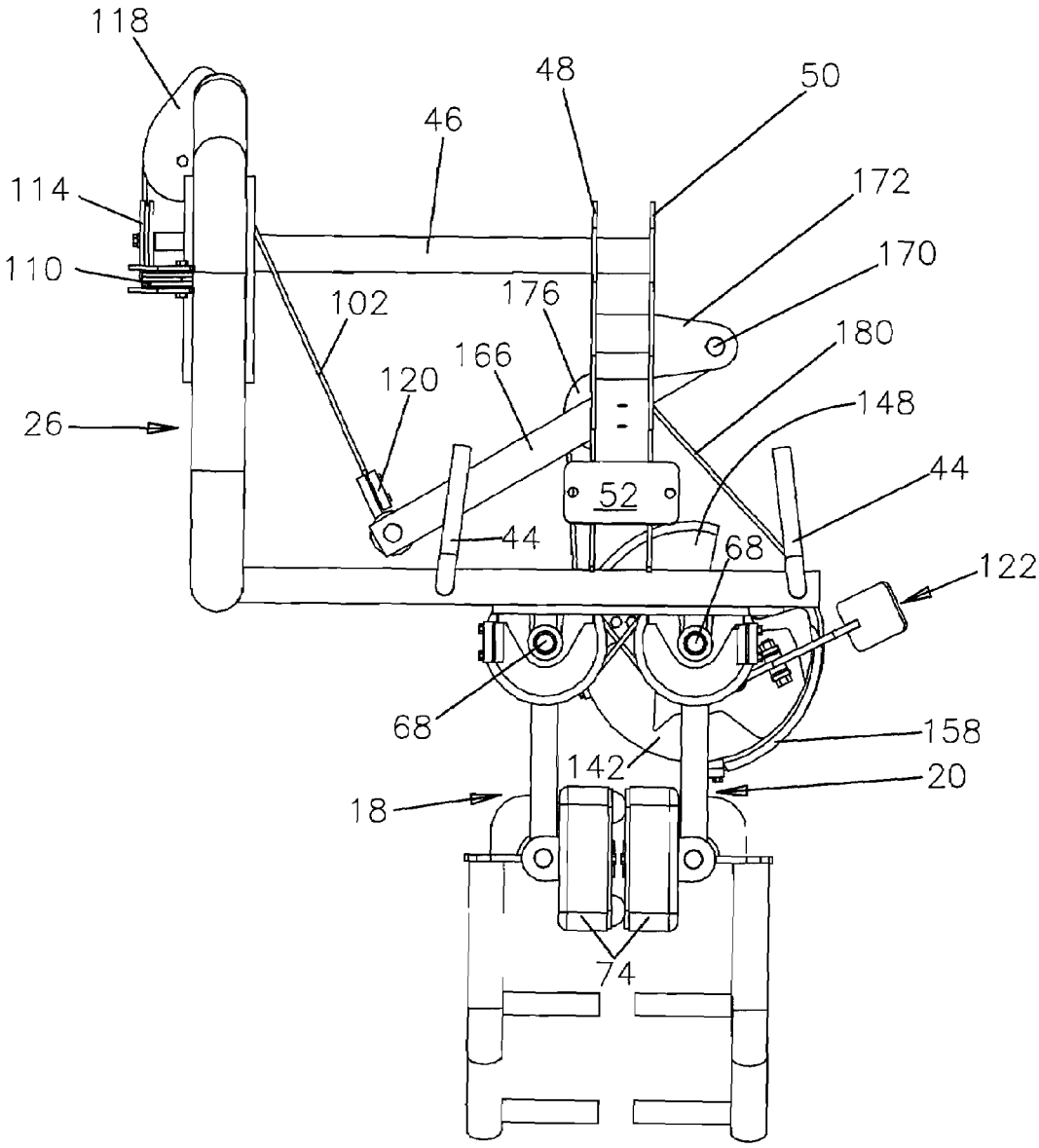
FIG. 10 is a top view of the machine of FIG. 9.

The exerciser can now exert pressure on the thigh pads with the inner portion of the thighs causing the leg supports 18, 20 to rotate on their respective pivot shafts 68 so that they move towards each other as shown in FIGS. 9 and 10. As the left leg support 12 is rotated clockwise, the engagement pin 146 presses against the right end of the slot 164 in the lower cam plate 158 and causes it to rotate clockwise. The engagement pin 146 rides free in the slot 156 of upper cam plate 148 and does not cause it to rotate. Stop block 154 on upper cam plate 148 engages lower front transverse member 42 of the framework 12 and further prevents clockwise rotation. Driving the lower cam plate 156 clockwise pulls the cam connecting cable 180 and forces the swing arm 166 counterclockwise. This pulls the weight stack cable 102 lifting the weight plates 94 and imposing resistance to the movement of the leg supports 18, 20 as they move towards their finished position shown in FIGS. 9 and 10.

The present invention thus provides an exercise machine 10 which permits efficiently exercising muscles of the inner and outer thighs by employing a unique motion transfer assembly 24 strategically mounted and arranged on the machine framework 12 between a pair of pivotable leg supports 18, 20 and a resistance arrangement 22. The motion transfer assembly 24 includes actuating lever 122, range limiter plate 142, slotted upper and lower cam plates 148, 158 and swing arm 166 to enable changing the start position of the leg supports 18, 20 without imposing resistive force of the resistance arrangement 22 thereon while separately imposing the resistive force only as the leg supports 18, 20 are moved between start and finished positions.

In the embodiment described, the actuating lever 122, range limiter plate 142, and the upper and lower cam plates 148, 158 are positioned on the left leg support 20. However, it should be understood that with the rack 26 to the left of the seat 14, these operating components could be designed in a mirror image on the right leg support 18 with the identical expected results.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

I claim:

1. A combination inner and outer thigh exercise machine comprising:

a framework;

a seat and a backrest joined to the framework;

right and left leg supports pivotally mounted on the framework on spaced apart pivot shafts relative to the seat and the backrest, and interconnected so as to pivot one with the other in opposite angular directions between start and finish positions;

thigh engaging structure freely rotatably secured on the leg supports for selectively engaging inner and outer portions of an exerciser's thighs;

a resistance arrangement operatively connected to the leg supports for imposing a resistive force on the leg supports during pivoting movement thereof between start and finish positions;

an adjustment assembly associated with one of the leg supports for selectively enabling changing the start positions of the leg supports without imposing the resistive force of the resistance arrangement thereon, the adjustment assembly having a portion mounted for selective rotation on the pivot shaft associated with the one leg support and including a range limiter plate mounted for selective rotation on the pivot shaft associated with the one leg support; and a resistive force imposing assembly having a portion mounted for selective rotation on the pivot shaft associated with the one leg support and directly engaged with the portion of the adjustment assembly to impose the resistive force on the leg supports as the leg supports are pivoted between the start and finish positions, wherein the portion of the resistive force imposing assembly includes an upper cam plate and a lower cam plate, each cam plate being separately engageable with the range limiter plate and wherein the resistive force imposing assembly also includes an elongated swing arm having one end pivotably connected about a first vertical axis on the framework and an opposite end directly attached to the resistance arrangement, the swing arm having a pulley rotatably mounted thereon adjacent the one end about a second vertical axis spaced from the first vertical axis, the pulley moving with the swing arm as the swing arm pivots, there being a cable commonly engageable about peripheral surfaces of the pulley, the upper cam plate and the lower cam plate.

2. The exercise machine of claim 1, wherein the resistance arrangement includes a weight stack having a cable operatively connected to the resistive force imposing assembly.

3. The exercise machine of claim 1, wherein the leg supports include right and left foot supports on forward ends thereof.

4. The exercise machine of claim 3, wherein the leg supports include a pair of bearing tubes between the foot supports and the pivot shafts for receiving the thigh engaging structure.

5. An adductor and abductor exercise apparatus comprising:

a framework;

a seat and a backrest joined to the framework;

right and left leg supports pivotally mounted on the framework on spaced apart pivot shafts relative to the seat and the backrest, and interconnected so as to pivot one with the other in opposite angular directions between start and finish positions;

thigh engaging structure freely rotatably secured on the leg supports for selectively engaging inner and outer portions of an exerciser's thighs;

a resistance arrangement operatively connected to the leg supports for imposing a resistive force on the leg supports during pivoting movement thereof between the start and finish positions;

an actuating lever connected to one of the leg supports for selectively pivoting a spring-biased pin between a non-engagement position and an engagement position to establish selected start positions for the leg supports without imposing the resistive force thereon;

a range limiter plate engageable and disengageable with the pin of the actuating lever, and mounted for selective rotation on the pivot shaft associated with the one leg support, the range limiter plate being provided with an engagement pin fixed thereon;

an upper cam plate mounted for selective rotation on the pivot shaft associated with the one leg support and formed with a slot for selectively receiving the engagement pin on the range limiter plate;

a lower cam plate mounted for selective rotation on the pivot shaft associated with the one leg support and formed with a slot for selectively receiving the engagement pin of the range limiter plate;

an elongated swing arm having one end pivotally attached about a first vertical axis to the framework rearwardly of the leg supports and an opposite end directly connected to a first cable attached to the resistance arrangement;

a pulley rotatably mounted on the swing arm about a second vertical axis spaced from the first vertical axis and movable with the swing arm as the swing arm pivots about only the one end; and a second cable directly engaged with peripheral surfaces of the upper cam plate, the pulley and the lower cam plate, whereby disengagement of the spring-biased pin from the range limiter plate allows movement of the leg supports to various start positions without rotation of the range limiter plate, and whereby pivoting of the leg supports between start and finish positions with the spring-biased pin engaged in the range limiter plate, enables rotation of the range limiter plate and only one of the upper and lower cam plates causing a corresponding movement of the second cable, pulley and swing arm to impose the resistive force on the leg supports during movement between the start and finish positions.

6. The apparatus of claim 5, wherein the upper and lower cam plates have cable retaining and guide structure provided thereon.

7. The apparatus of claim 5, including a pair of sheaves rotatably mounted on the pivot shafts and interconnected by a third cable for enabling pivoting of the leg supports in opposite angular directions.

* * * * *